US005622491A

United States Patent [19]

Van Belle

[11] Patent Number: 5,622,491

[45] Date of Patent: Apr. 22, 1997

[54] GAS BURNER HAVING A PACK OF STACKED METAL PLATES AT THE COMBUSTION CHAMBER INLET

[75] Inventor: Arie Van Belle, Am Gouda, Netherlands

[73] Assignee: Flameco-Eclipse, B.V., Gouda, Netherlands

[21] Appl. No.: 28,157

[22] Filed: Mar. 9, 1993

[30] Foreign Application Priority Data

Mar. 12, 1992 [NL] Netherlands ..... 92 00460

[51] Int. Cl.[6] ..... F23D 14/02; F23D 14/62; F23D 14/70

[52] U.S. Cl. ..... 431/328; 431/7; 431/170; 431/347; 431/115; 431/116

[58] Field of Search ..... 431/326, 328, 431/7, 170, 329, 116, 347, 115

[56] References Cited

U.S. PATENT DOCUMENTS

| | | | |
|---|---|---|---|
| 1,372,724 | 3/1921 | Stine | 431/328 X |
| 1,789,226 | 1/1931 | Ensign et al. . | |
| 1,901,086 | 3/1933 | Cox | 431/347 X |
| 1,910,020 | 5/1933 | Boutillier et al. | 431/328 |
| 2,251,710 | 8/1941 | Livar . | |
| 3,053,316 | 9/1962 | Flynn | 431/328 X |
| 3,170,504 | 2/1965 | Lanning | 431/328 |
| 4,919,609 | 4/1990 | Sarkisian et al. | 431/328 X |

FOREIGN PATENT DOCUMENTS

| | | | |
|---|---|---|---|
| 38023 | 12/1970 | Australia . | |
| 458725 | 12/1972 | Australia . | |
| 558007 | 6/1957 | Belgium | 431/328 |
| 381252 | 8/1990 | European Pat. Off. . | |
| 1565689 | 3/1969 | France . | |
| 1054038 | 4/1959 | Germany . | |
| 2151429 | 4/1973 | Germany . | |
| 3125513 | 1/1983 | Germany . | |
| 9001813 | 4/1990 | Germany . | |
| 2500192 | 7/1995 | Germany . | |
| 0036411 | 2/1991 | Japan | 431/326 |
| 6402237 | 3/1964 | Netherlands . | |
| 159935 | 3/1921 | United Kingdom | 431/347 |
| 416802 | 9/1934 | United Kingdom | 431/347 |
| 1078951 | 8/1967 | United Kingdom | 431/328 |
| 1354113 | 6/1974 | United Kingdom . | |
| 1565310 | 4/1980 | United Kingdom . | |
| 2191022 | 3/1986 | United Kingdom . | |
| 2214629 | 1/1988 | United Kingdom . | |
| 388886 | 9/1990 | United Kingdom . | |

OTHER PUBLICATIONS

Gas World, decl 164, nr. 4293, 26 Nov. 1966, Bladzijden 548–549, Leslie T. Minchin "The Stabilized Wedge–Cavity Burner".

*Primary Examiner*—Carl D. Price

*Attorney, Agent, or Firm*—Beveridge, DeGrandi, Weilacher & Young, L.L.P.

[57] ABSTRACT

A gas burner is described, provided with a connection for supplying a mixture of combustible gas and combustion air, and a burner pack comprising a plurality of stacks of at least one metal plate which is deformed transversely to its flat plane, and at least one flat metal plate on both sides of each deformed plate, which stacks of burner plates are separated by a solid filler and said plates with their main surfaces being parallel to the flow direction of the gas/air mixture, wherein per stack the flow direction of the gas/air mixture from the flow channels bounded by said deformed plate and said flat plates is the same.

According to the invention, each stack of burner plates comprises two or more deformed plates.

9 Claims, 9 Drawing Sheets

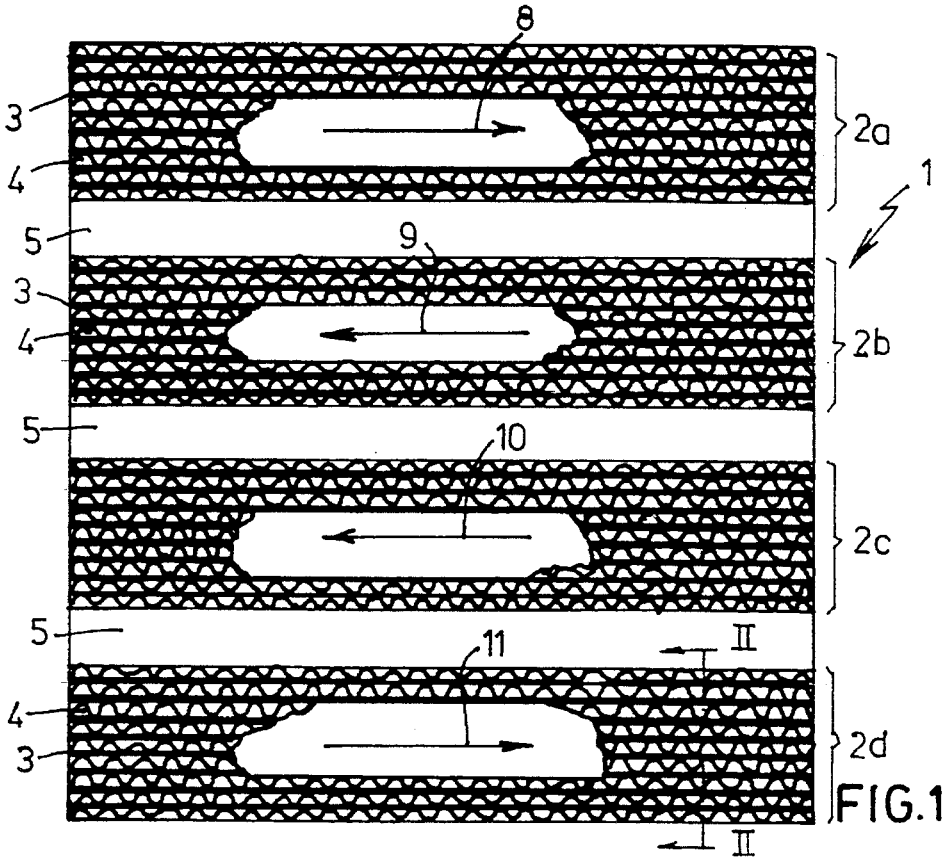
FIG.1
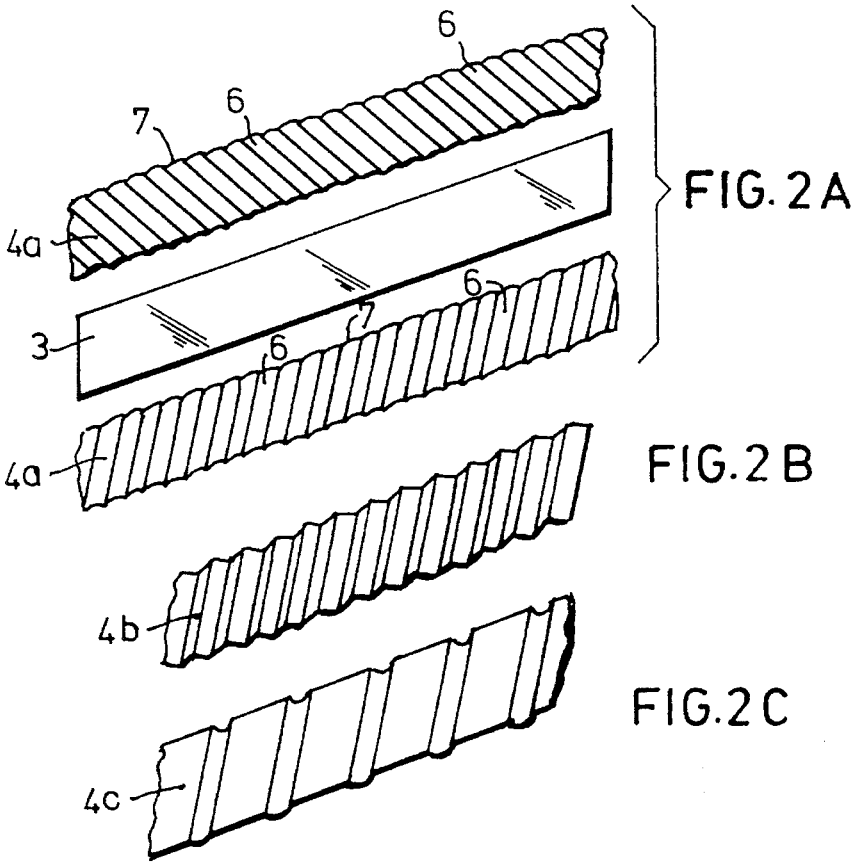
FIG. 2A
FIG. 2B
FIG. 2C

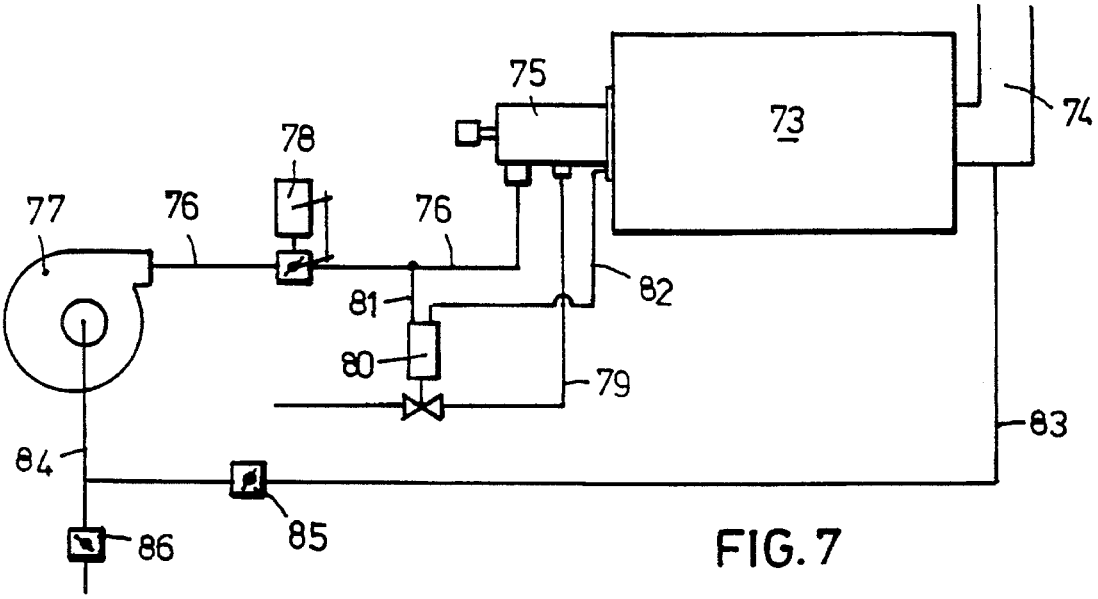
FIG. 7
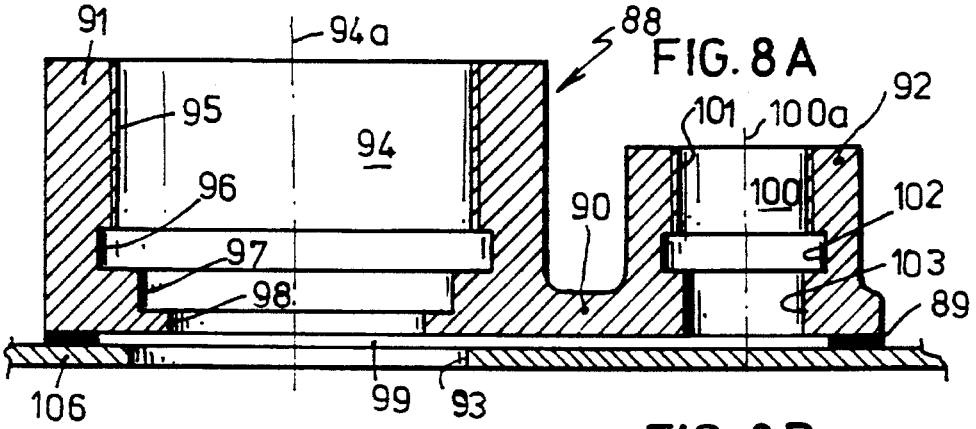
FIG. 8A
FIG. 8B
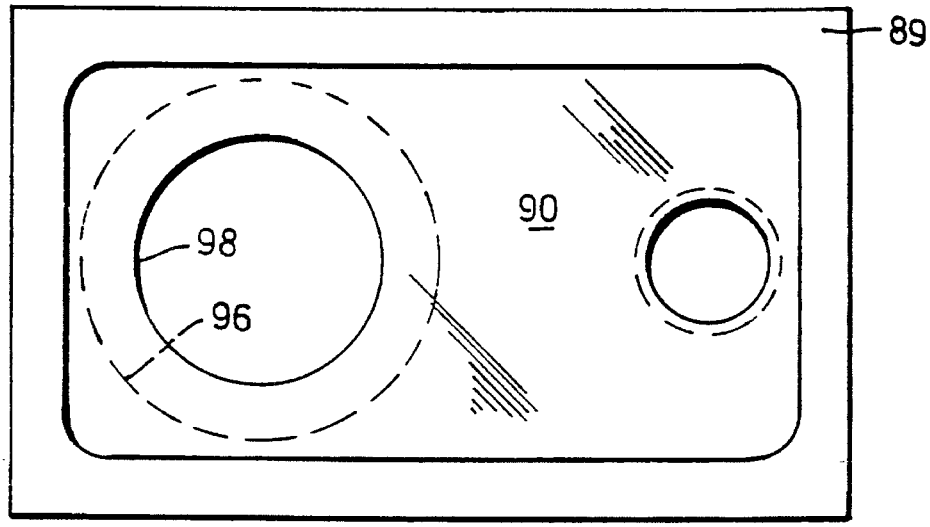

GAS BURNER HAVING A PACK OF STACKED METAL PLATES AT THE COMBUSTION CHAMBER INLET

BACKGROUND OF THE INVENTION

In connection with the environmental requirements, which are tightened up time and time again, it has become necessary to develop improved burners and burner systems in order to comply with these requirements. The NOx-emissions (substantially nitrogen-oxides) of the burner installation is of great importance herewith, since NOx contributes to the acidification of the environment. Lowering the NOx-content of the flue gasses can be attained by using premixed burners and by supplying additional combustion air and/or recirculating flue gases to the burner. As a result, the flame temperature becomes more uniform and at the same time lower and less NOx is formed. Metal or ceramic objects are also used and are disposed in the flame. These objects radiate the heat from the flame to colder surfaces and through conduction they make the flame temperature more uniform.

A general drawback of the present gas burners which premixed combustion air and gas is the relatively low maximum load or capacity per surface unit of the burner body, thus the object, from which the mixture of gas and air flows.

In the present gas burners with a low NOx-content in the combustion gases and which comprise premixing, the burner head comprises a porous ceramic plate or a ceramic plate with bores or a heat-resisting fibrous plate or a porous metal plate, which is made of metal wires and/or fibres or of electrolytically produced porous material. Each of these embodiments has its own drawbacks: the ceramic plates are fragile, the fibre plates are mechanically not strong either, and the porous metal plates consist of wires and/or metal fibres which become too hot with certain loads, because they cannot radiate their heat to the cold material behind them.

BACKGROUND OF THE INVENTION

The invention relates to a gas burner provided with a connection for supplying a mixture of combustible gas and combustion air, and a burner pack comprising a plurality of stacks of at least one metal plate which is deformed transversely to its flat plane, and at least one flat metal plate on both sides of each deformed plate, which stacks of burner plates are separated by a solid filler and which plates with their main surfaces being substantially parallel to the flow direction of the gas/air mixture, wherein per stack the flow direction of the gas/air mixture from the flow channels bounded by the deformed plate and the flat plates is the same.

Such a gas burner is known from Dutch patent application No. 64 02237 laid open to public inspection. With this known gas burner the stacks of burner plates each time comprise one corrugated plate and two flat plates or strips on both sides of the corrugated plate. This known burner may only operate with the stoechiometric amount of air which involves a high flame temperature, so that the flue gases obtain a high NOx-content which may even be about 60 ppm.

The invention aims at removing the objections of the known gas burners with a low NOx-emission and a low CO-content.

This purpose is attained, in that according to the invention each stack of burner plates comprises two or more deformed plates.

In this way, a much higher amount of air per unit of combustible gas can be added, so that the flame temperature can drop considerably and that the NOx-content may even be reduced to about 2 ppm.

Furthermore, by applying these measures the maximum load or capacity of the gas burner may be increased to 10 to 15 times the maximum load or capacity of the known low NOx-gas burners.

With a preferred embodiment of the gas burner wherein the deformed plates are corrugated, according to the invention the longitudinal centerlines of the corrugations in the plates of at least two adjacent stacks enclose an angle.

With this embodiment of the gas burner a very high capacity and load, respectively, per surface unit and a good flame stability are obtained. The various gas flows cross one another and therefore cause in the combustion chamber a strong whirl of the burning gases of the mixture, wherein the flue gases are sucked back into the flame by being blown out into various directions so that circulation patterns develop.

With a particularly efficient embodiment of the gas burner according to the invention at least a part of the flat burner plates on the flame side of the burner pack extends beyond the longitudinal edges of the corrugated burner plates. By applying this measure the possible occurrence of sound caused by the gas burner may be prevented.

The invention also relates to a mixing device for combustion air and combustible gas which is suitable for use in a gas burner according to the invention.

According to the invention the mixing device consists of one or more mixing modules, which are each provided with a mixing plate which is perpendicularly to the flow direction of the combustion air and which is provided with a ring of bent blades which are partially cut out of the plate and bent out of the plane of the plate and in that an axially closed tube is positioned concentrically to the ring of blades on the mixing plate, said tube being connected to a gas supply conduit and wherein a ring of radial discharge holes is provided.

By applying these measures the combustion air and the combustible gas are intensively mixed with one another with each mixing module, so that the NOx- and CO-content of the flue gases are reduced to a minimum, while a high mixing capacity per surface unit of the mixing device can be obtained. The ratio of the mixing capacity per surface unit of the present mixing device in relation to that of the known mixing devices is about 15 to 20:1. Additionally the present mixing device may be accommodated in a very small space which is about 15 times smaller than the space needed for the known mixing devices. Furthermore, the mixing device may be constructed for any load or capacity by simply selecting the desired number of modules which can be stored easily.

According to the invention a gas burner which is provided with a connection for supplying a mixture of combustion air and combustible gas, is also provided with a mixing flange, the centerlines of the ducts of which for supplying gas and air are perpendicularly to the longitudinal centerline of the burner and lie in a plane which is displaced outwardly with respect to the longitudinal centerline of the burner.

Due to this position of the ducts for supplying combustion air and combustible gas, these gases are brought into the burner housing in a helical whirl and are therefore intensively mixed with one another.

This intensive mixing can still be improved in that according to the invention the air supply duct of the mixing flange is provided with a constriction, and in that between the mixing flange and the wall of the burner housing a slot-shaped space is present, to which space the gas supply duct is connected.

Because of the rapid flow of combustion air, optionally mixed with flue gases, through the constriction in the mixing flange combustible gas is as it were sucked into the air flow through the slot-shaped space and as a result intensively mixed with the air flow/flue gases owing to the strong whirls caused therewith.

The invention also relates to a heating installation which is provided with a gas burner, a device for supplying combustion air and a gas supply conduit which are connected to a mixing device connected to the gas burner, wherein a proportional control valve is applied in the gas conduit leading to the mixing device.

According to the invention the installation is provided with a gas burner according to the invention and with a mixing device according to the invention, and with a thermocouple, the measuring probe of which being placed in the flame of the gas burner, the thermocouple being connected to a temperature controller, and said temperature controller being connected to a correction control valve in the gas conduit between the proportional control valve and the mixing device.

By using the gas burner and the mixing device according to the invention a heating installation is obtained which operates with very low values of NOx- and CO-contents in the fuel gases and which has a high maximum capacity and load capacity, respectively. The proportional controller of the heating installation may operate reliably at a ratio of the maximum to the minimum amount of combustion air with the accompanying amount of combustible gas to about 15:1. By using the control with the thermocouple, the temperature controller and the correction valve, the ratio maximum/minimum combustion air and combustible gas may be adjusted reliably and accurately at a value to about 30:1.

It is remarked that the ratio of the amount of combustion air to the amount of combustible gas is always substantially constant and is about 15:1. This ratio applies to the burning of natural gas in installations for heating process air. With other gases and/or installations other ratios may apply.

The invention finally relates to a heating installation which is provided with a gas burner, a device for supplying combustion air and a gas supply conduit, which are connected to a mixing device connected to the gas burner, wherein a proportional control valve is applied in the gas conduit in the mixing device.

According to the invention the installation is provided with a gas burner according to the invention and with a mixing device according to the invention, and with an auxiliary burner which is connected to the conduit between the mixing device and the gas burner by means of a branch conduit, the measuring probe of a thermocouple being placed in the flame of the auxiliary burner, said thermocouple being connected to a temperature controller and said temperature controller being connected to a correction control valve coupled to the proportional valve.

Thanks to the use of an auxiliary burner for controlling the ratio of the amount of combustion air to the amount of combustible gas by means of the control device with thermocouple, temperature controller and correction control valve, the mentioned ratio may be maintained in a reliable and accurate manner and this with a very low CO and NOx-content over the entire range from the maximum load and capacity to the minimum load, respectively, which amounts to about 1/30 of the maximum capacity.

With the heating installation according to the invention it is possible to produce flue gases or discharge gases without CO and with about two ppm NOx (two parts of NOx per million parts of flue gases). This applies to a large part of the capacity range.

BRIEF DESCRIPTION OF THE DRAWINGS

The invention will be further elucidated in the light of a few embodiments reproduced in the drawings.

FIG. 1 is a schematical front view of a burner pack of the gas burner according to the invention, seen in the direction parallel to the longitudinal axis of the burner, FIG. 2A is a schematical reproduction of the construction of a burner pack, the FIGS. 2B and 2C show other embodiments of the deformed plates of the burner pack, the FIGS. 3A, 3B and 3C show flame stabilizing plates of the gas burner according to FIG. 1, the FIGS. 4A up to and including 4G show other embodiments of flame stabilizers for the gas burner, FIG. 7 shows schematically a heating installation according to the invention, the FIGS. 8A and 8B are a cross-sectional and bottom view, respectively, of the mixing device of the heating installation according to FIG. 7.

DESCRIPTION OF THE PREFERRED EMBODIMENTS

Figure 14:
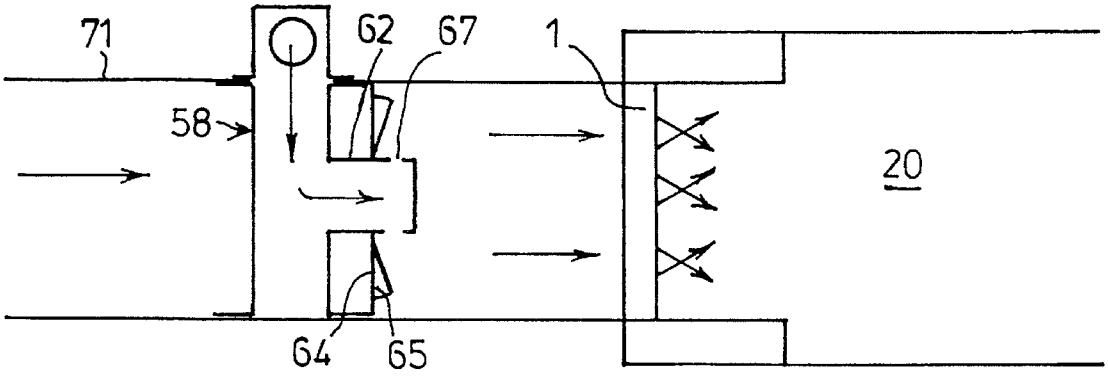
FIG. 14 is a schematic view of a burner which utilizes the burner pack of FIG. 1 and the mixing device of FIG. 6.

As shown in FIG. 14, the apparatus has an air supply conduit 71, a mixing device 58 which receives gas from a gas supply means, and a burner pack 1 which is located at the inlet of a combustion chamber 20. The mixing device has an axial tube 62 with radially oriented discharge holes 67. The holes 67 are located immediately downstream of a mixing plate 64 which has a number of guide blades 65, details of which will be explained subsequently in this specification. Gas is released from the discharge holes 67 so that the gas is immediately subjected to a swirling flow of air for mixing purposes prior to its arrival at the burner pack 1. To enhance the combustion which occurs in chamber 20, the burner pack 1 creates a number of discrete oppositely directed streams as will be subsequently described.

In FIG. 1 the front view of the burner pack of the burner according to the invention is drawn schematically and the FIGS. 2A, 2B and 2C show the construction and some other embodiments of the deformed plates of the burner pack.

The burner pack 1 consists of four stacks 2*a*–2*d* of metal plates 3 and 4, the large surfaces of which being parallel to the flow direction of the mixture of combustion air and combustible gas and which are alternately arranged, the plates 3 being flat and the plates 4 being deformed transversely to their flat plane, in such a way, that flow channels exist between the flat and the deformed plates, and the stacks 2*a*–2*d* of metal plates being separated from one another by a solid filler 5.

However, the preferably used corrugated plates 4*a* according to FIG. 2A may be replaced by zizagly deformed plates 4*b* (FIG. 2B) or by plates 4*c* (FIG. 2C) with spaced corrugations. Furthermore, the deformed plates may be provided with spherical bulges, lips cut loose on two sides at the longitudinal edges, which lips are bent out of the plane of the plates, semi-spherical bulges applied to the longitudinal edges, or other deformed parts which are transverse to their large or flat surfaces in such a way, that flow channels exist between the flat and the deformed plates.

Consequently, the corrugated plates 4*a* are preferably used, wherein the longitudinal direction of the grooves 6 enclose an acute angle with the longitudinal edges 7 of the deformed plates 4*a* which are perpendicularly to the flow direction of the mixture. In the embodiment the longitudinal centerlines of the corrugations 6 in the plates 4*a* of two adjacent stacks 2*a*–2*b* and 2*c*–2*d* enclose an angle of about 90°, and the acute angle is about 45°.

In the burner pack according to the FIGS. 1 and 2A up to and including 2C the longitudinal edges of the flat plates 3 and the deformed plates 4 are substantially perpendicularly to the flow direction of the gas through the burner pack and perpendicularly to the longitudinal centerline of the gas burner, respectively.

The burner pack 1 according to FIG. 1 is consequently preferably constructed in such a way, that the mixture of combustion air and combustible gas in the upper snack 2*a*, seen in relation to the plane of the drawing, flows upwardly and to the right under an angle of about 45°, arrow 8, in the second stack 2*b* upwardly and to the left under an angle of about 45°, arrow 9, in the third stack 2*c* upwardly and to the left under an angle of about 45°, arrow 10, and in the fourth stack 2*d* upwardly and to the right under an angle of about 45°, arrow 11. As a result the burning gas flows bounce against the walls of the combustion chamber and cause strong whirls in the burning gases which benefits the flame stabilisation and the contents of damaging materials.

Figure 2D:
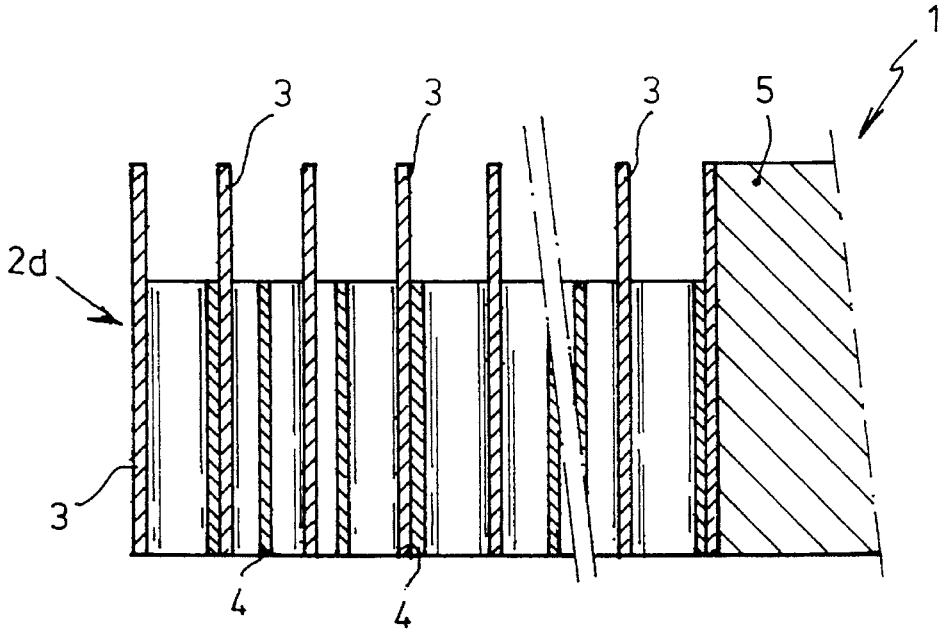
FIG. 2D shows a cross section of a burner pack of the gas burner according to the invention.

From FIG. 2D it appears that the flat burner plates 3 on the flame side of the burner pack 1 extend outside the longitudinal edges of the corrugated burner plates 4. Thanks to this greater height of the flat burner plates it is possible to prevent sound to be produced by the gas burner.

In order to be able to produce the burner pack 1 easily and rapidly, the fillers 5 are formed by stacks of flat plates 3.

According to the invention instead of the burner pack 1, a flat plate 12 (FIG. 3A, 3B, 3D) may be used, in which plate lips 13, 14, 15 are partially cut out and are bent under an acute angle out of the plane of the plate. These lips 13, 14 and 15 give a better flame stability by changing the flow direction and flow patterns of the mixture. Optionally, in the plates 12 expansion slots 16 may be provided and under the plate 12 metal gauze or metal sponge 17 or other porous material may be provided to avoid flash back of the flame.

Figure 4A:
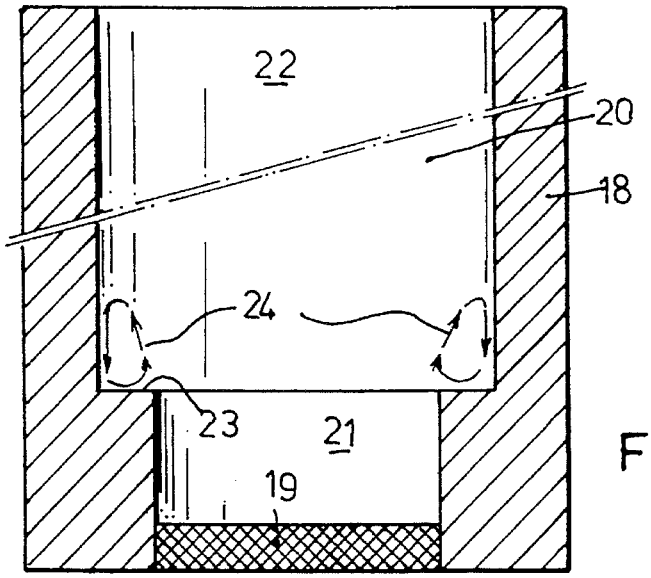

The FIGS. 4A up to and including 4G show various embodiments of flame stabilizers. FIG. 4A schematically shows a burner 18 with a burner pack 19 which may be the same as the burner pack 1 according to FIG. 1. In the combustion chamber 18 a second flame stabilizer is formed in that the combustion chamber 20 has a relatively narrow portion 21 and a relatively wide portion 22 so that a shoulder 23 is formed, downstream of which whirls or circulation patterns 24 are formed, which have a flame stabilizing effect.

Figure 4B:
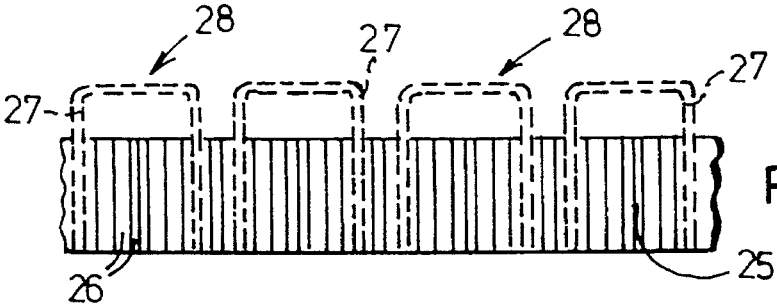

FIG. 4B shows a cross-section at a large scale of a burner pack 25 which may correspond with the burner pack 1 according to the FIGS. 1 and 2, wherein between the plates 26 of the pack 25 the legs 27 of U-shaped bent pieces 28 of heat resistant gauze are inserted, which have a flame stabilizing effect. The pieces of gauze 28 are also used to carry away heat.

Figure 4C:
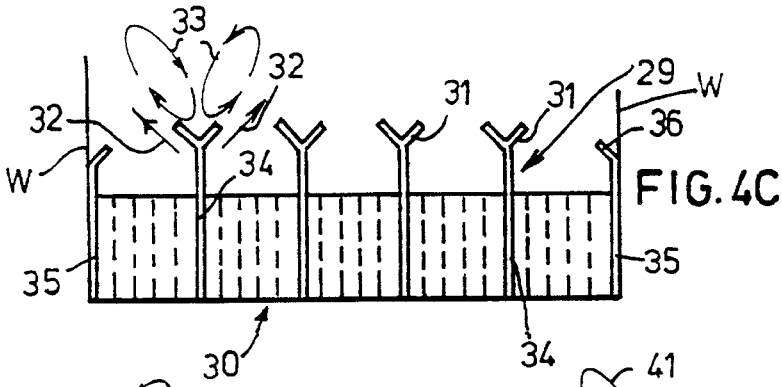

According to FIG. 4C the flame stabilizers consist of Y-shaped strips 29 which extend over the entire width and height, respectively, of the burner pack 30. The strips 29 are provided with V-shaped heads 31 under an angle of about 45°, resulting in that circulation patterns 33 are formed by the flow 32 of the mixture which have a favourable stabilizing effect on the flame. The strips 29 are also provided with "legs" 34 with which they are inserted between the strips of the burner pack 30. Along the side edges of the burner pack 30 strips 35 are placed which are bent inwardly at the upper edge 36, which upper edges 36 have the same effect as the V-shaped heads 31.

Figure 4D:
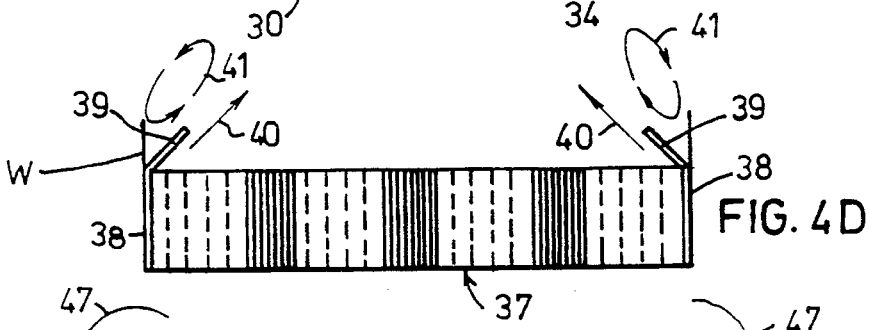

The burner pack 37 according to FIG. 4D is provided with strips 38 which are placed sideways over the entire width and height, respectively, the upper edges 39 of which are bent inwardly under an angle of about 45° above the pack 37, as a result of which the mixture flows 40 are directed inwardly and circulation patterns or whirls 41 are formed which stabilize the flame in the same manner as with the embodiment according to FIG. 4C.

Figure 4E:
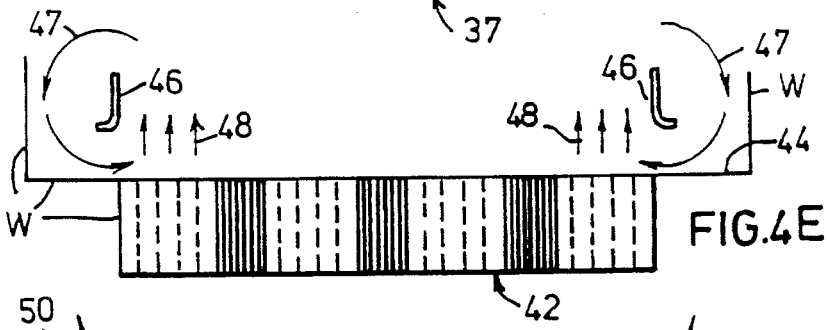
Figure 4F:
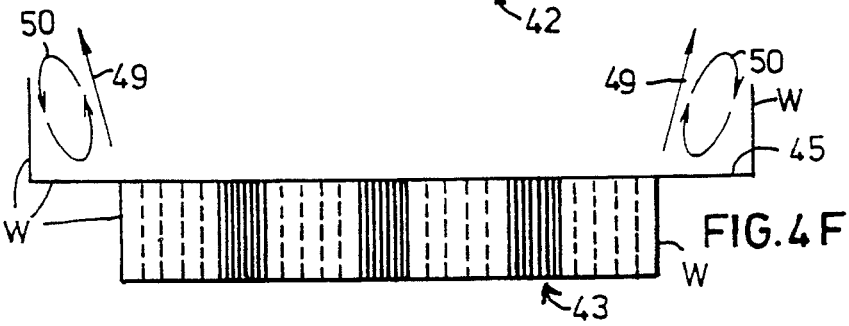

With the embodiments according to the FIGS. 4E and 4F the burner pack 42 and 43, respectively, is placed directly downstream of a shoulder 44 and 45, respectively, in the wall W of the combustion chamber. According to FIG. 4E J-shaped strips 46 are placed downstream of the shoulder 44 and approximately at the height of the side edges of the burner pack 42, said J-shaped strips being secured to the walls of the combustion chamber and extending over the entire width and height, respectively, thereof. The J-shaped strips 46 cause circulation patterns and whirls 47 in the mixture flows 48. According to FIG. 4F circulation patterns and whirls 50, respectively, are formed in the mixture flows 49 by the widening of the combustion chamber at the height of the shoulder 45. The circulation patterns 47 and 50 have a flame stablizing effect.

Figure 4G:
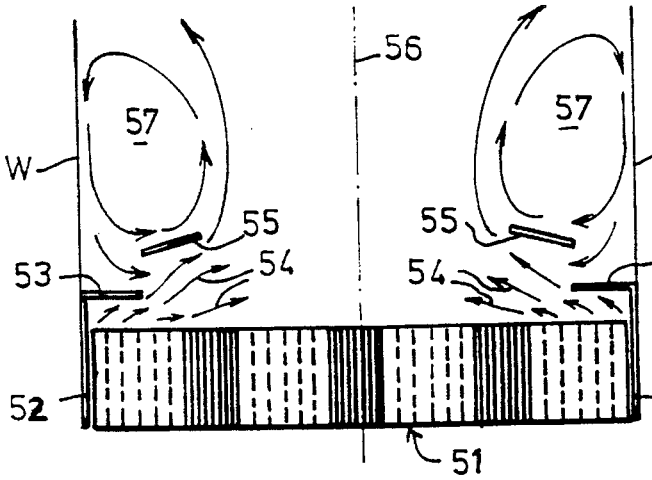

According to FIG. 4G strips 52 are provided between the sides of the burner pack 51 and the wall W of the combustion chamber, the upper edges 53 of said strips being bent inwardly and thereby causing mixture flows 54. Further strips 55 are positioned in the combustion chamber which enclose a great angle with the longitudinal centerline 56 of the burner and are practically perpendicular to the longitudinal centerline of the burner, respectively, and which are downstream and inwardly of the upper edges 53. This converts the mixture flows 54 into flame stabilizing circulation patterns 57.

Figure 3A:
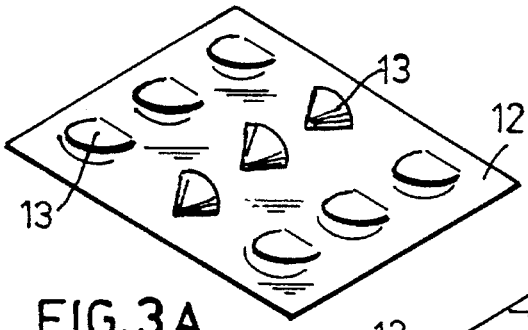
Figure 3B:
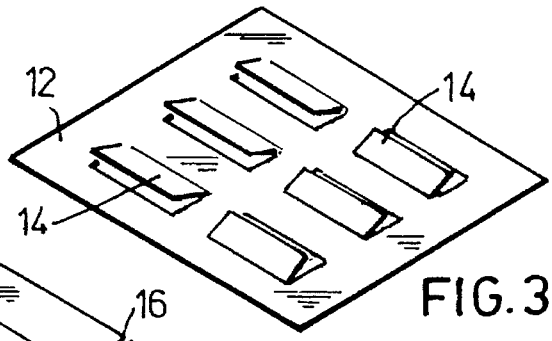
Figure 5:
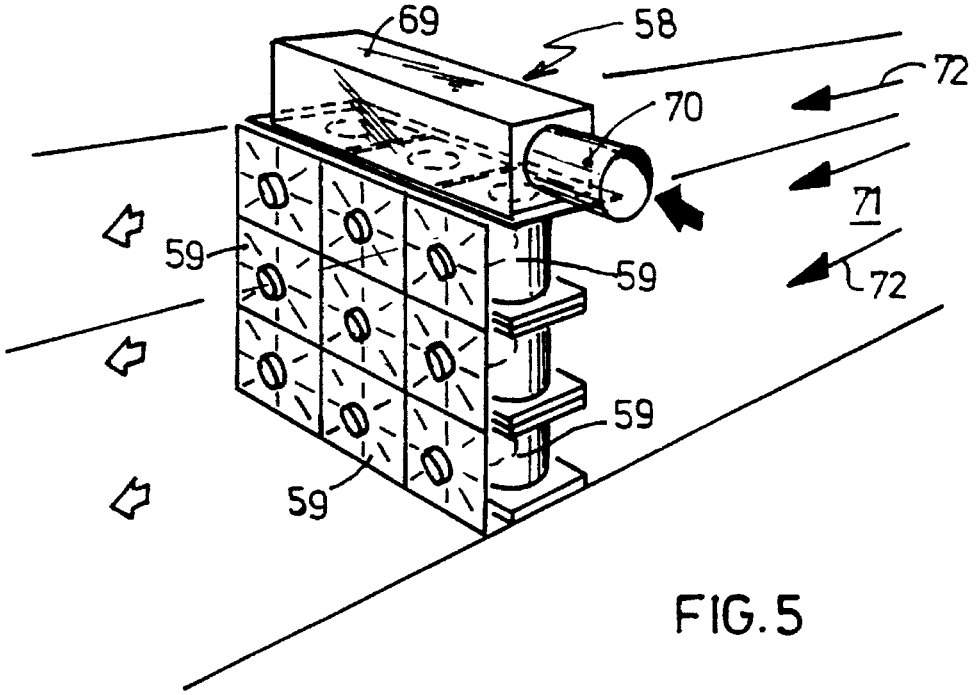
FIG. 5 is a perspective view of a mixing device constructed of nine modules in a combustion air duct.

FIG. 5 shows a mixing device according to the invention for combustion air and combustible gas, which mixing device is suitable for use in a gas burner according to the invention, the burner pack 1 of which is drawn in the FIGS. 1 and 2 which may optionally be provided with the flame stabilizers according to FIGS. 3A up to and including 3C and 4A up to and including 4G.

Figure 6:
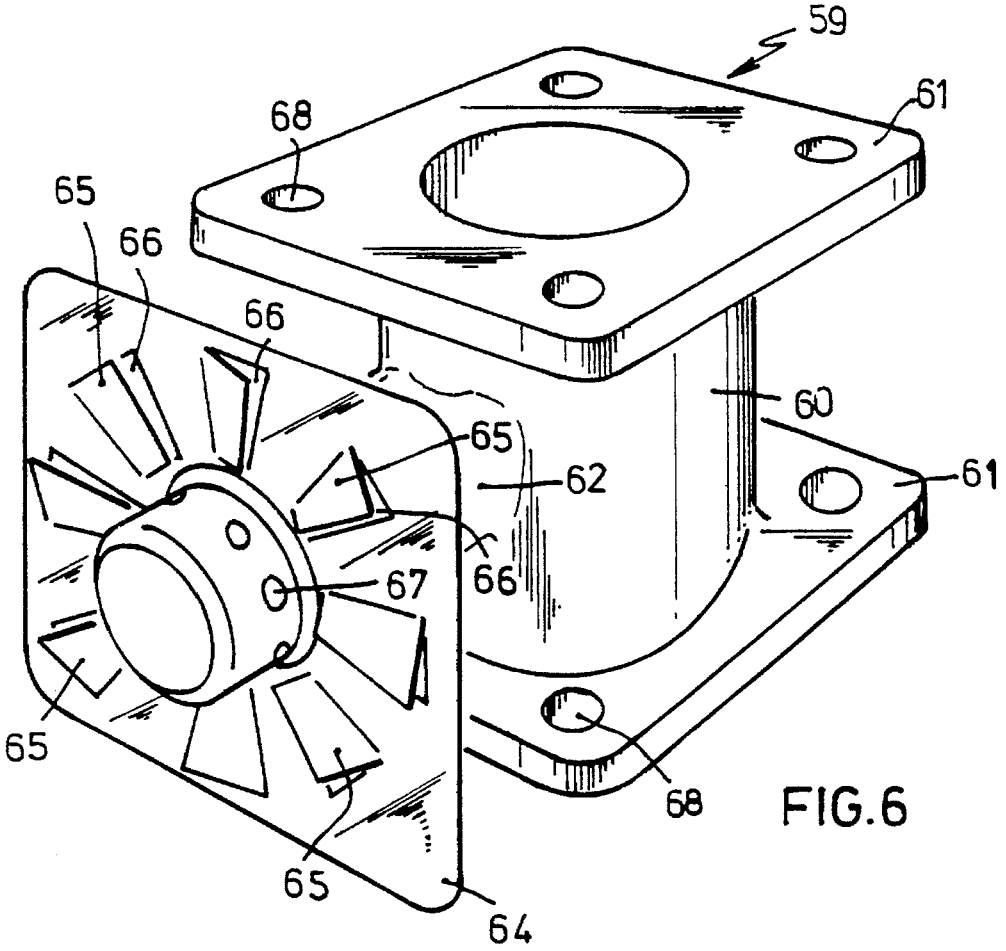
FIG. 6 is a perspective view of one module of the mixing device according to the invention.

The mixing device 58 according to FIG. 5 consists of 9 mixing modules 59, a perspective view of which is reproduced in detail in FIG. 6. The mixing module 59 consists of a short tube 60 which at both ends is provided with a connecting flange 61. Approximately in the middle a tube 62 is connected perpendicularly to the tube 60, which tube is closed at its free end and connected to a duct 63 in the tube 60 and to which a mixing plate 64 is mounted adjacent the free end, said mixing plate being provided with a ring of guide blades 65 which are partially cut out of the plate 64 and bent from the plane of the plate 64 above openings 66 in the mixing plate 64. The tube 62 is provided with a ring of radial discharge holes 67 between its free, closed end and the mixing plate 64. The connecting flanges 61 are furthermore provided with fastening holes 68.

The mixing device 58 according to FIG. 5 is constructed in this example by stacking three mixing modules 59 with the flanges 60 and by connecting them by means of connecting bolts through the holes 68 in the flanges 61. In this way three of such stacks are formed which are connected to one another at the upper side by means of a gas distribution box 69 with a connecting tube 70 which is connected to a gas supply conduit (not shown). The gas distribution box 69 may be connected to the upper connecting flanges 61 of the mixing modules 59 by means of connecting flanges at the bottom side (not shown). The bottom ends of the ducts 63 in the modules are sealed properly (not shown). It stands to reason that also the connections between the distribution box 69 and the modules 59 and between the modules 59 mutually are sealed properly.

The mixing device 58 operates as follows: the mixing device 58 is placed in an air supply conduit 71 between e.g. a blower and a gas burner (not shown). The combustion air flows in the direction of the arrows 72 through the conduit 71 and along and between the modules 59. Additionally, the air bounces against the mixing plates 64 and flows through the holes 66 beneath the guide blades 65 in a whirling flow away from the mixing plates 64. The combustible gas is supplied into the distributor box 69 by means of a conduit (not shown) and the connecting tube 70, flows through the ducts 63 and then through the tubes 62 and flows radially outwards through the holes 67. There the radial gas flows are intensively mixed with the whirling flows of combustion air and thereby forming a homogenous mixture of gas and combustion air which is supplied to the gas burner.

FIG. 7 shows schematically a heating installation according to the invention. The installation comprises a boiler 73 with a flue gas exhaust 74 and a burner 75. With said burner 75 a combustion air ventilator or blower 77 is connected with an air conduit 76, where a capacity control valve 78 is applied into the conduit 76, as well as a gas supply conduit 79 with a proportional control valve 80. The proportional control valve 80 is connected to the air conduit 76 by means of a reporting line 81 and to the combustion chamber of the gas burner 75 by means of a reporting line 82. The flue gas exhaust 74 is connected to an air supply conduit 84 to the ventilator/blower 77 by means of a return line 83. In the lines 83 and 84, respectively, a fixedly adjusted valve 85 and 86, respectively, are provided.

The heating installation according to FIG. 7 operates as follows: the ventilator/blower 77 sucks combustion air through the line 84 with the fixedly adjusted valve 85, thereby adding an amount of flue gases to the combustion air through the line 83 with the fixedly adjusted valve 85. The blower 77 forces the mixture of combustion air and flue gases through the conduit 76 leading to the burner 75, wherein the desired amount of air/flue gases is adjusted by means of the capacity control valve 78. The combustible gas is supplied through the conduit 79 to the burner 75, wherein the desired amount of gas is adjusted by means of the proportional control valve 80. This amount of gas is adjusted in the proportional control valve 80 with a valve which is influenced by the pressure in the air conduit 76 by means of the reporting line 81 and by the pressure in the fire place of the boiler 73 by means of the reporting line 82. The obtained mixture of combustion air and flue gases is supplied to the burner through the conduit 76, and the combustible gas is supplied to the burner 75 through the conduit 79.

The FIGS. 8A and 8B show the mixing flange according to the invention of the burner 75 of the heating installation according to FIG. 7. On the side wall 106 of the burner 75, see also FIG. 9, the mixing flange 88 is mounted, a packing 89 being placed between side wall 106 and mixing flange 88, which packing ensures the sealing and which is shown in bottom view in FIG. 8B.

The mixing flange 88 principally consists of a base plate 90 and integral nipples 91 and 92, wherein the large nipple 91 is used for connecting the air conduit 76 and the small nipple 92 is used for connecting the gas conduit 79. The side wall 106 is provided with an annular hole 93 which is concentrically with respect to the nipple 91.

The nipple 91 has a multi-staged bore 94 with centerline 94*a*, which, seen from the outside to the inside, consists of a screw thread portion 95 for connecting the air conduit 76, a widened portion 96 with a greater diameter than portion 95, a constriction 97 the diameter of which is smaller than that of portion 95, and a constriction 98 the diameter of which is again smaller than that of portion 97. Through the constriction 97, the constriction 98 and the wall of the hole 93 in the side wall of the burner a kind of venturi tube is formed, wherein the air flows through the constriction 98 with a relatively high speed and wherein gas is sucked through a slot 99 between mixing flange 88 and side wall 106. The function of the venturi tube will be further described hereinafter.

The nipple 92 also has a multi-staged bore 100 with centerline 100*a*, which, seen from the outside to the inside, consists of a screw thread portion 101 for connecting the gas conduit 79, a widened portion 102 with a greater diameter than portion 101, and a constriction 103 with a smaller diameter than that of portion 101, and which connects to the slot 99.

Because the air flows through the "constriction" 97-98-93 with a relatively high speed, the gas supplied in the slot 99 by the nipple 92 is strongly sucked in the direction perpendicularly to the air flow, so that there is already a strong mixing of combustion air and gas before it is introduced into the burner housing.

Figure 9:
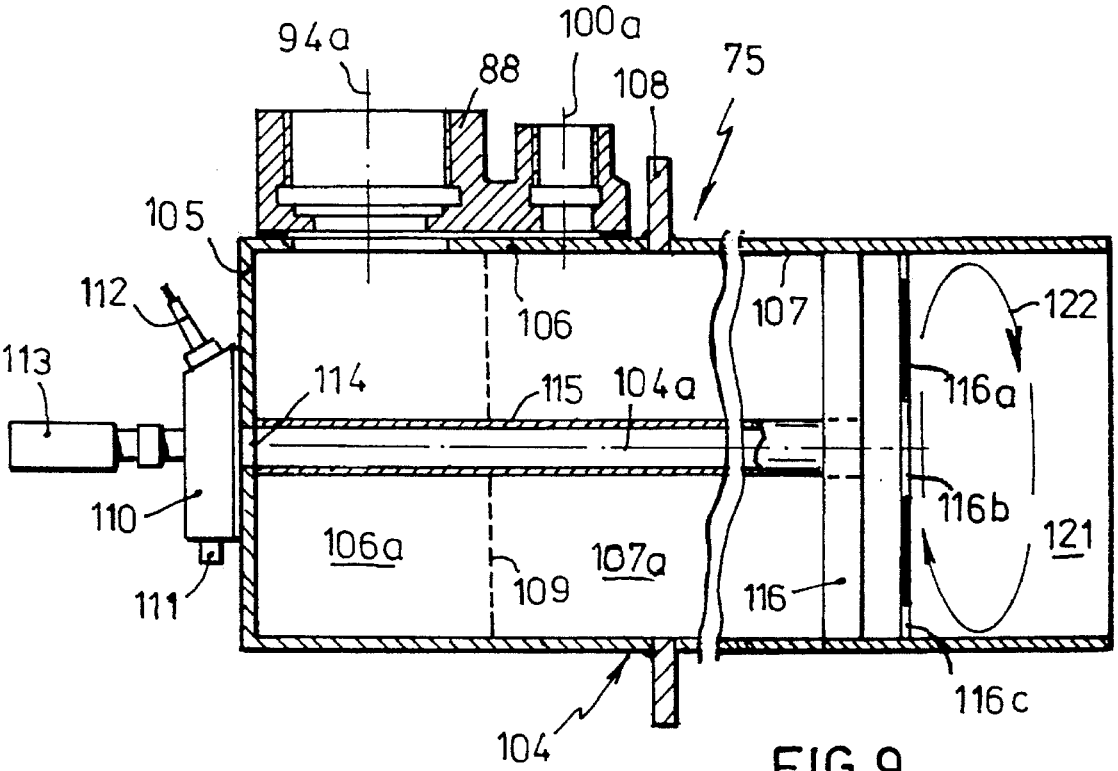
FIG. 9 shows a schematical longitudinal section of the burner of the heating installation according to FIG. 7.

FIG. 9 shows schematically the burner 75 of the heating installation according to FIG. 7. The burner 75 comprises a housing 104 with centerline 104*a* and with a front end wall 105 and a side wall 106, 107. The centerlines 94*a* and 100*a* lie in a plane which is parallel to the centerline 104*a* and is displaced outwardly with respect thereto, the mixing flange 88 being mounted between the longitudinal center plane of the burner and the side wall 106 of the burner housing 104. The side wall 87 consists of a left portion 106 with a square or rectangular cross-section and a right portion 107 with an annular cross-section. The left portion 106 has a square or rectangular cross-section to facilitate the mounting of the mixing flange 88, but the portion 106 could, of course, also be annular and be manufactured integrally with the right portion 107. The portions 106 and 107 of the burner housing 104 are separated from one another by a fastening flange 108 so that housing portions 106a and 107*a* are formed. Furthermore, in the left portion 106 of the burner housing yet a distribution plate 109 is mounted which is made of porous material or provided with a great number of regularly devided bores or other openings (not shown).

Further, a casing 110 is mounted concentrically on the side wall 105 of the burner housing 104, and is provided with a nipple 111 for connecting a conduit for the supply of the ignition gas, an ignition plug 112 and an UV-detector tube 113 to monitor the flame of the burner 75. The casing 110 which is connected to a tube 115 through an opening 114 in the side wall 105 for the ignition flame and UV-detection of the flame, which tube 115 at its right end is mounted concentrically in an annular burner pack 116, see FIG. 10.

Figure 10:
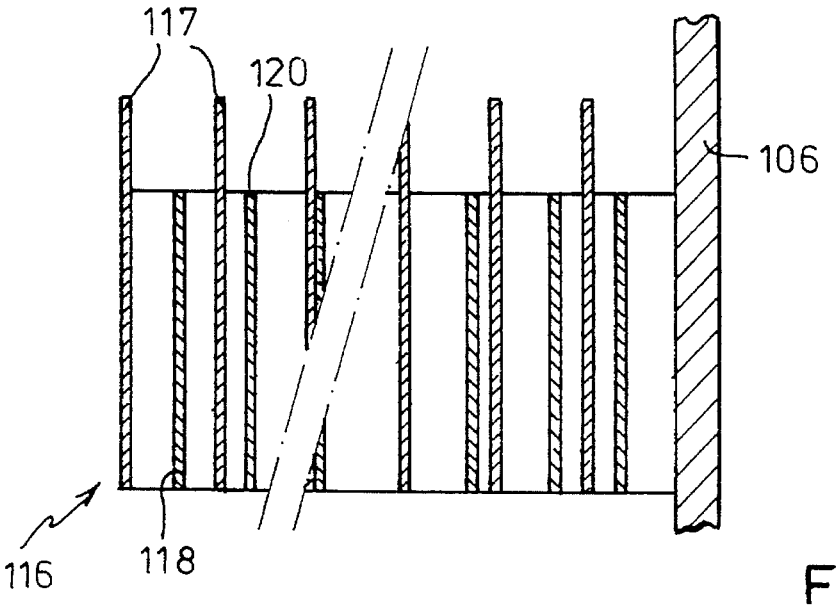
FIG. 10 shows a half, diametrical cross-section of the burner pack according to FIG. 9.

The burner pack 116 according to FIG. 10 is constructed of a spiral-shaped coil of a flat strip 117 and of a strip 118 lying thereon and which is deformed transversely to its flat plane in such a way, that flow channels exist between the flat and the deformed strips. According to the invention, at least a portion of the spiral-shaped flat strip 117 at the flame side of the burner pack 116 extends beyond the longitudinal edge 120 of the spiral-shaped deformed strip 118. In this way the possible occurrence of sound caused by the gas burner can be prevented. The flat strip 117 and the deformed strip 118 may be made of the same material as that of the flat strip 3 and the deformed strip 4, respectively, of the burner pack 1 according to the FIGS. 1, 2*a*, 2*b* and 2*c*. The deformed strip 118 is preferably corrugated, but may also have one of the other embodiments described above on the basis of the FIGS. 1 and 2A up to and including 2C. The deformed strip 118 is preferably provided with corrugations 119, the longitudinal direction of which preferably encloses an acute angle of 45° with the longitudinal edges 120 of the deformed strip 118. The combustion chamber 121 of the burner 75 is at the outside or right side of the burner pack 116. Spaced from the burner pack 116 a flame stabilizing plate 116*a* is placed in the combustion chamber 121 of the burner 75, said flame stabilizing plate may have a central opening 116*b* and/or openings 116*c* at its periphery.

The burner 75 operates as follows: the mixture of combustion air, flue gases and combustible gas formed in and downstream of the slot 99 (see FIG. 8A) is supplied tangentially into the housing portion 106*a*, which causes turbulence in the mixture and homogenous mixture. The mixture flows through the distribution plate into the right housing portion 107 and through the burner pack 116 into the combustion chamber 121. Thanks to the flow channels under an angle of 45°, which are formed by the corrugations 119 and their spiral course, the combustible mixture is blown into the combustion chamber in a rotating whirl 122 about its longitudinal centerline 104*a*, in which chamber a complete combustion takes place due to this whirl and wherein the flue gases have a low NOx- and CO-content. The burner pack 116 also prevents flash back of the flame.

When the burner 75 is lit, firstly ignition gas is supplied through the nipple 111 and the tube 115, and then it is ignited by the plug 112. Then the mixture supplied by the pack 116 is lit with the ignition flame and which flame is monitored by the UV-detector tube 113 and the tube 115, and whereafter the ignition flame is put out.

Figure 11:
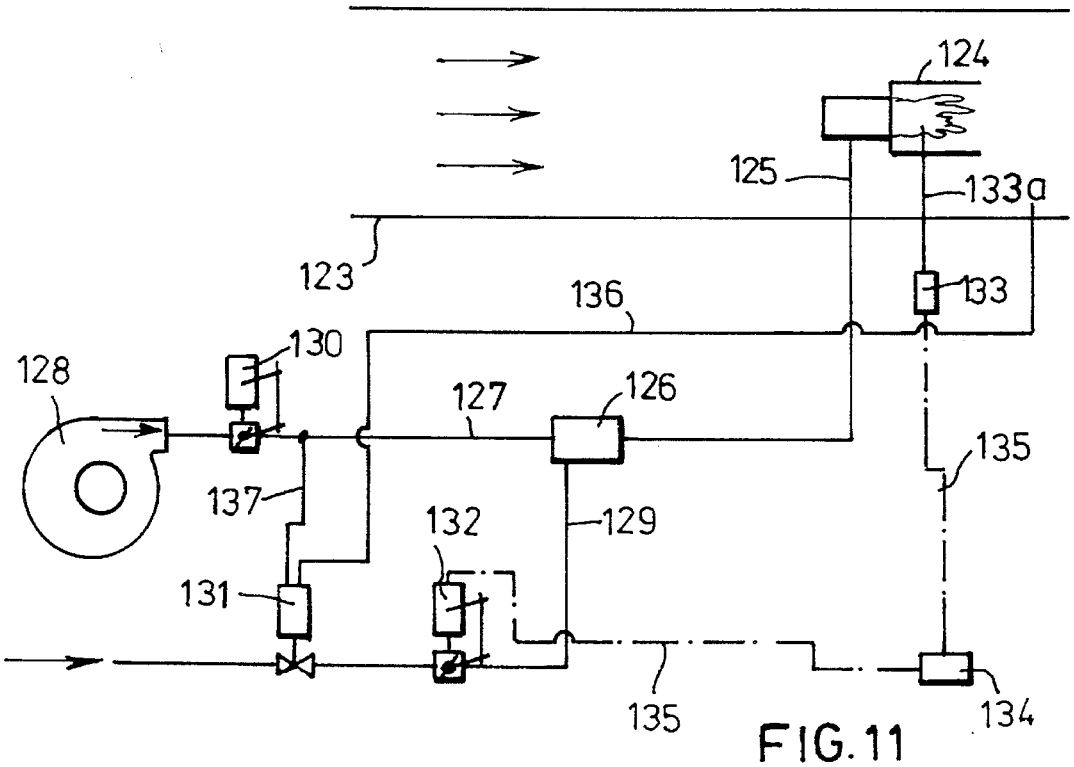
FIG. 11 is a diagram of a heating installation according to the invention.

In FIG. 11 a heating installation according to the invention is shown which in this example is suitable for heating so-called process air which is i.a. used for drying products, heating factories, other large buildings and similar installations.

Figure 3C:
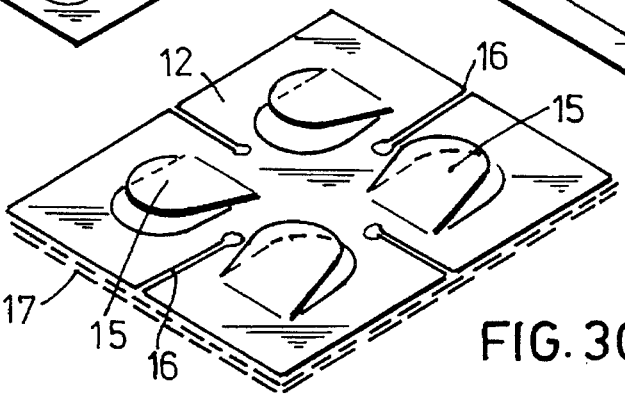

The installation according to FIG. 11 is meant for heating process air flowing through a conduit 123. For that purpose a burner 124 is arranged in the conduit 123 which is provided with a burner pack 1 corresponding to the FIGS. 1 and 2, optionally with one or more flame stabilizing elements according to FIGS. 3 and 4. The burner 124 is connected to a mixing device 126 by means of a conduit 125, said mixing device corresponding to the mixing device according to FIGS. 5 and 6 and to which are connected a conduit 127 for supplying combustion air supplied by a ventilator 138, and a supply conduit 128 for combustible gas.

The installation according to FIG. 11 is furthermore provided with a capacity control valve 130 in the conduit 127, a proportional control valve 131 in the conduit 129, a correction control valve 132 in the conduit 129, and a thermocouple 133 with a feeler 133a, and a temperature/voltage controller 134 in a conduit 125 between thermocouple 133 and correction control valve 132, the thermocouple 133 with its feeler 133*a* extending into the flame of the burner 124. Finally, between the conduit 123 and the proportional control valve a conduit 136 is provided for reporting back the conduit pressure and between the air conduit 127 and the proportional control valve 131 a conduit 137 is provided for reporting back data.

The installation according to FIG. 11 aims at controlling the ratio between the amount of air and gas supplied to the burner 124 in such a way that the CO- and NOx-content in the combustible flue gasses are minimized. The essence of the invention in the installation according to FIG. 11 is that controlling said ratio between the amounts of combustion air and gas supplied to the burner 124 is effected dependent on the temperature of the flame in the burner 124. In the installation according to FIG. 11 this control is merely effective at low load, i.e. at a load and capacity, respectively, wherein the supplied amount of gas is about 1/15 of the maximum amount, down to the minimum load, wherein the supplied amount of gas is about 1/30 of the maximum amount.

The installation according to FIG. 11 operates as follows: the desired flame temperature is adjusted at the temperature controller 134, i.e. a voltage corresponding with the desired temperature. The thermocouple 133 delivers a voltage which depends on the temperature of the flame. In the temperature controller 134 the voltage delivered by the thermocouple 133 is compared to the adjusted voltage. If the voltages are equal, the temperature of the flame is correct as well as the ratio combustion air : gas. When the temperature of the flame drops by any cause whatsoever, then the voltage delivered by the thermocouple 133 is lower than the voltage adjusted at the temperature controller 134, and the temperature controller 134 controls a servomotor of the correction control valve 132 in such a way, that the supplied amount of gas increases until the voltage delivered by the thermocouple 133 is again equal to the voltage adjusted at the temperature controller 134 and that the temperature controller 134 does not change the position of the correction control valve 132 again.

When the flame temperature of the burner becomes higher than the adjusted value, the voltage delivered by the thermocouple 133 is higher than the voltage adjusted at the temperature controller 134, and the controller 134 controls the servomotor of the correction control valve 132 in such a way that the supplied amount of gas becomes smaller, until the thermocouple voltage is again equal to the voltage adjusted at the controller 134.

The load and capacity, respectively, of the burner, in the range of amount of air:amount of gas of 1:1 to 15:1 is controlled by means of the proportional control valve 131, in which range the correction control valve 132 is completely open. The proportional control valve 131 delivers an amount of gas which depends on the pressure in the air conduit affecting the control valve 131 through the conduit 137, and the pressure in the process air conduit 123 affecting the control valve 131 through the conduit 136.

In the installation according to FIG. 11 the capacity control valve 130, the proportional control valve 131, the correction control valve 132, the thermocouple 133 and the temperature and voltage controller 134, respectively are known to a person skilled in the art, so they do not need to be further elucidated.

Figure 12:
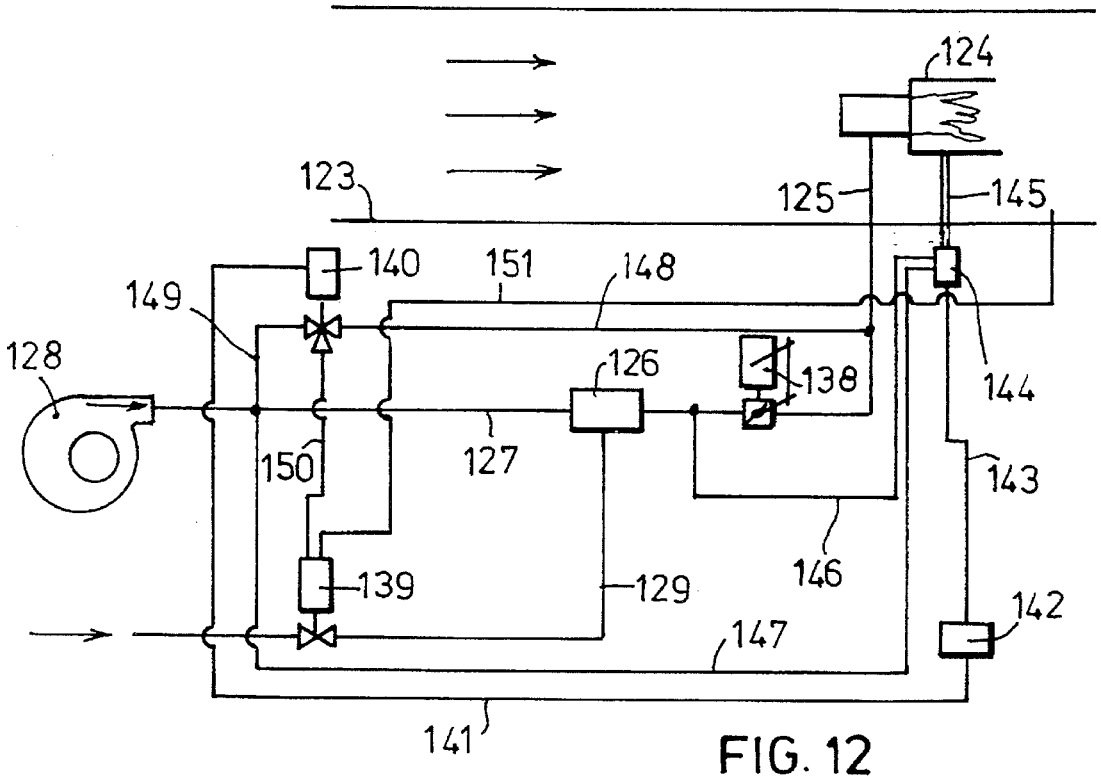
FIG. 12 is a diagram of an other heating installation according to the invention.

The installation according to FIG. 12 as well as the installation according to FIG. 11 is designed for heating process air. The installation according to FIG. 12 substantially corresponds with the installation according to FIG. 11 which is a simplified embodiment of the installation according to FIG. 12. The installation according FIG. 12 comprises, as well as the installation according to FIG. 11, the process air conduit 123, the burner 124, the conduit 125, the mixing device 126, the conduit 127, the ventilator or blower 128 for the combustion air, and the gas supply conduit 129. These parts of the installation according to FIG. 12 are the same as those of the installation according to FIG. 11.

Except for the above-described parts, the installation according to FIG. 12 is furthermore provided with a capacity control valve 138 in the conduit 125, a proportional control valve 139 in the gas conduit 129, a correction control valve 140 which is connected to a correction or temperature controller 142 by a conduit 141, said correction or temperature controller 142 in its turn being connected to a so-called auxiliary burner or correction receiver 144 by a conduit 143. The auxiliary burner 144 is connected to the main burner 124 by a tube 145 for exhausting combustion gases from the auxiliary burner 144. The auxiliary burner 144 is furthermore connected to the mixture conduit 125 by a conduit 146, and to the air conduit 127 by a conduit 147 for supplying cooling air to the auxiliary burner 144.

The correction control valve 140 is furthermore connected to the mixture conduit 125 by a conduit 148, by a conduit 149 to the air supply conduit 127 and by a conduit 150 to the proportional control valve 139. The proportional control valve 139 is connected to the process air duct 123 by a conduit 151. The correction control valve 140 is a three way valve with three bores, to which the conduits 148, 149 and 150 are connected. The three bores debouch into a channel (not shown), in which a rotatable shaft fits, in which shaft a peripheral groove is applied over an angle within which the three bores debouch into the channel. By rotating the shaft, the pressure in the conduit 150, which is connected to the proportional control valve 139, can be changed and in this way the position of said conduit be corrected. The proportional control valve 139 is in principle a butterfly valve in the conduit 129, the position of which can be changed by pressure changes in the conduits 150 and 151. The capacity control valve 138, the proportional control valve 139, the correction control valve 140 and the voltage controller 142 are apparatus, which are known per se and which are commercially available.

Figure 13:
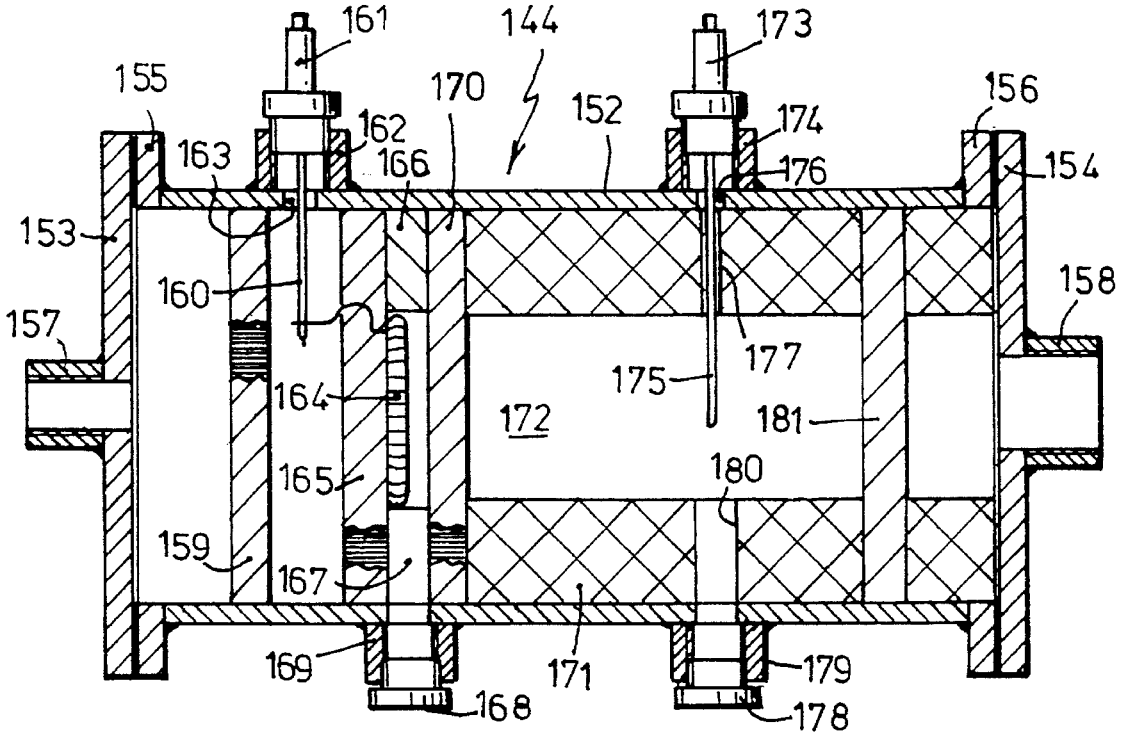
FIG. 13 shows a schematical longitudinal section of the auxiliary burner of the installation according to FIG. 12.

The auxiliary burner 144 of the installation according to FIG. 12 is shown in detail and in longitudinal cross-section in FIG. 13. The auxiliary burner 144 is for example accommodated in a cylindrical casing 152 which at its ends with a packing 153*a* and 154*a*, respectively, is sealed by a lid 153 and 154, respectively, which lids are attached to the flanges 155 and 156 of the casing. The lid 153 has a central connecting (tube) stub 157 for the conduit 146 (FIG. 12) for supplying the mixture of combustion air and combustible gas, and the lid 154 has a central flue gas discharge (tube) stub 158 which is connected to the combustion chamber of the burner 124 by the tube 145 (FIG. 12).

In the casing 152 of the auxiliary burner 144 the following parts are placed from the left to the right in FIG. 13: a flame flash back plate 159, a current supplying electrode 160 which is disposed with a bushing insulator 161 in a connecting nipple 162 on the outer wall of the casing 152, and which extends through a hole 163 in the casing 152 and is connected to a glowing spiral wire 164, a flame stabilizing plate 165 consisting of a perforated ceramic plate, a closed ceramic ring 166 within which the glowing spiral wire 164 is placed and which is provided with a recess 167, while opposite the recess 167 a looking glass 168 is mounted in a connecting nipple 169 on the outer wall of the casing 152.

The auxiliary burner 144 is furthermore provided with a perforated ceramic plate 170, wherein the ring 166 is positioned between the plates 165 and 170, an insulation casing 171 of fibrefrax with a large wall thickness which is placed against the inner wall of the casing 152 and bounds a combustion chamber 172 in the auxiliary burner 144, a thermocouple 173 which is mounted in a connecting nipple 174 on the outer wall of the casing 152, and which protrudes with a measuring probe 175 through a bore 176 and 177, respectively in the casing 152 and the insulation casing 171, in the combustion chamber 172, a looking glass 178 which is mounted on the outer wall of the casing 152 opposite the thermocouple and connecting nipple 179 and wherein a bore 180 is provided in the insulation casing 171 between the sight glass 178 and the measuring probe 175, and finally a radiation plate 181 which serves to prevent heat radiation from the measuring probe 175 to a cold surface and which radiation plane consists of a perforated ceramic plate.

The mixture formed by the mixing device 126 is branched from the mixture supply conduit 125 (FIG. 12) by the conduit 146 and supplied into the auxiliary burner 144 through the connecting (tube) stub 157. The mixture flows through the flame flash back plate 159 and the flame stabilizing plate 165 in the inner space of the ring 170 and is ignited by the glowing spiral wire 164, the flame of the burning mixture substantially burning in the combustion chamber 172. The flue gases of the flame of the auxiliary burner 144 are discharged to the gas burner 124 of the installation according to FIG. 12 by the tube 158 and the conduit 125.

The installation according to the FIGS. 12 and 13 operates as follows: the voltage controller 142 adjusted to a specifically desired flame temperature of the main gas burner 124, so in fact adjusted to a specific voltage. In the auxiliary burner 144, to which the same mixture is supplied as to the main burner 124, this flame temperature is measured by the measuring probe 175 of the thermocouple 173 which delivers a specific voltage to the temperature controller and voltage controller 142, respectively. When the voltage supplied by the thermocouple is now equal to the adjusted voltage on the voltage controller 142, the temperature is correct and in this way the voltage controller 142 does not affect the correction control valve 140.

When the temperature of the flame and consequently therewith the voltage supplied by the thermocouple 173 decreases or increases, the voltage controller 142 sends a signal to the correction control valve 140 which depends on the measured difference with the adjusted voltage, as a result of which said correction control valve 140 is rotated, so that the proportional control valve 139 is opened further or less far by means of the control pressure provided by the conduit 150, so that the supplied amount of gas increases or decreases, respectively, until the measured voltage and the adjusted voltage on the voltage controller 142 are equal again.

The installation according to FIG. 12 aims at controlling the ratio between the supplied amount of air and gas to the burner 124 in such a way, that the CO- and NOx-content in the combustion flue gases is minimized. The essence of the invention in the installation according to FIG. 12 is that the control of said ratio between the amounts of combustion air and gas supplied to the burner 124 takes places depending on the temperature of the flame in the auxiliary burner 144.

In the installation according to the FIGS. 12 and 13 this control operates from the maximum load and capacity, respectively, to the minimum load and capacity, respectively, at which the supplied amounts of combustion air and gas are about 1/30 of the maximum amounts.

I claim:

1. Gas burner provided with a connection for supplying a mixture of combustible gas and combustion air, a combustion chamber, and a burner pack located between said connection and said combustion chamber and providing an inlet to said combustion chamber, said burner pack comprising a plurality of stacks of plates; each stack including at least one metal plate which is deformed transversely to its flat plane, and at least one flat metal plate on both sides of each deformed plate; which stacks of burner plates are with their main surfaces substantially parallel to the flow direction of the gas/air mixture, wherein per stack the flow direction of the gas/air mixture from the flow channels bound by said deformed plate and said flat plates is the same, and wherein the deformed plates are corrugated, said burner pack having a flat flame side, each stack (2*a*–2*d*) of burner plates (3; 4*a*–4*c*) comprising two or more deformed plates (4*a*–4*c*) and the longitudinal centerlines of the corrugations (6) in the plates (4*a*–4*c*) of at least two adjacent stacks (2*a*–2*b*; 2*c*–2*d*) enclose an angle with each other and with the flame side.

2. Gas burner according to claim 1, wherein the longitudinal centerlines of the corrugations (6) in the plates (4*a*–4*c*) of at least two adjacent stacks (2*a*–2*b*); 2*c*–2*d*) enclose equal opposite angles with the flat flame side of the burner pack (1).

3. Gas burner according to claim 2, wherein said angle is approximately 45°.

4. Gas burner according to claim 1, wherein said stacks of burner plates (3,4) are arranged parallel and side by side in the burner pack.

5. Gas burner according to claim 1, wherein said stacks of burner plates (3,4) are separated by a solid filler (5).

6. Gas burner according to claim 5, wherein each solid filler (5) consists of a stack of flat burner plates (3).

7. Gas burner according to claim 1, wherein at least a part of the flat burner plates extends into the combustion chamber beyond the longitudinal edges of the corrugated burner plates (4*a*–4*c*) which lie between respective flat burner plates.

8. Gas burner provided with a connection for supplying a mixture of combustible gas and combustion air, said gas burner having a flame side and a longitudinal axis extending perpendicular to said flame side, said gas burner comprising means for releasing a plurality of streams of the combustion mixture, each stream being oriented and directed obliquely to the longitudinal axis and having a longitudinal component which is parallel to said longitudinal axis and a lateral component which is perpendicular to said axis, said lateral components of different streams being oppositely directed so as to balance out each other, said streams being oriented to provide circulation pattern which suck said combustion mixture back into the flame, said means for releasing a plurality of streams including a plurality of stacks of corrugated plates, each said stack including at least one corrugated metal plate, and at least one flat metal plate on each side of said corrugated metal plate.

9. Gas burner provided with a connection for supplying a mixture of combustible gas and combustion air, said gas burner having a flame side and a longitudinal axis extending perpendicular to said flame side, said gas burner comprising means for releasing a plurality of streams of the combustion mixture, each stream being oriented and directed obliquely to the longitudinal axis and having longitudinal component which is parallel to said longitudinal axis and a lateral component which is perpendicular to said axis, said lateral components of different streams being oppositely directed so as to balance out each other, said streams being oriented to provide circulation patterns which suck said combustion mixture back into the flame, said means for releasing a plurality of streams including a flat plate provided with lips which are partially cut out from the plate and are bent to lie at an acute angle relative to the flat plate, each of said lips having one edge connected to the flat plate.

* * * * *